US007845971B1

(12) United States Patent
Lee

(10) Patent No.: US 7,845,971 B1
(45) Date of Patent: Dec. 7, 2010

(54) POWER CONNECTOR STRUCTURE

(75) Inventor: Chun-Te Lee, Taipei (TW)

(73) Assignee: Longwell Company, Taipei (TW)

( * ) Notice: Subject to any disclaimer, the term of this patent is extended or adjusted under 35 U.S.C. 154(b) by 0 days.

(21) Appl. No.: 12/505,895

(22) Filed: Jul. 20, 2009

(30) Foreign Application Priority Data

May 15, 2009 (CN) ..... 2009 2 0156004 U

(51) Int. Cl.
*H01R 13/58* (2006.01)

(52) U.S. Cl. ..... 439/460; 439/459; 439/877

(58) Field of Classification Search ..... 439/459, 439/460, 685, 877
See application file for complete search history.

(56) References Cited

U.S. PATENT DOCUMENTS 3,624,591 A * 11/1971 Buberniak ..... 439/462
4,178,056 A * 12/1979 Lee ..... 439/472
4,931,023 A * 6/1990 Browne ..... 439/459
5,599,202 A * 2/1997 Key ..... 439/459
6,113,420 A * 9/2000 Harting et al. ..... 439/459

* cited by examiner

*Primary Examiner*—Hien Vu
(74) *Attorney, Agent, or Firm*—Muncy, Geissler, Olds & Lowe, PLLC

(57) ABSTRACT

A power connector structure is provided. The power connector includes a cable, an inner ring structure, an inner case, a strain relief structure, and an external cover. The inner case has a main body and an out-extending protrusion. The out-extending protrusion is set on the first opening proximate to the inner ring structure and elongates from an edge of the opening. The strain relief structure is set on the first opening proximate to the inner ring structure, substantially fills a gap within the opening, and covers the out-extending protrusion and a portion of the cable. The out-extending protrusion is utilized to enhance the bonding force between the inner case and the strain relief structure to improve the product reliability.

13 Claims, 7 Drawing Sheets

POWER CONNECTOR STRUCTURE

BACKGROUND OF THE INVENTION

1. Field of the Invention

The present invention relates to a connector, and more particularly to a reliable structure of a power connector.

2. Description of the Prior Art

With the prosperous development in multimedia industry, booming in electronic technology and popularization of personal computers, informational electronics are being widely used in our daily life. Since the power supplies of common portable electronic devices, e.g. a laptop, are connected to power connectors via power cords, the power connectors have now become an interesting topic for manufacturers and researchers to improve.

Generally, the internal structures of the power connector comprise inner cases, inner cores, terminals and so on, and the external cover covering the internal structures. A strain relief bushing is utilized to cover for insulation at the place where the power cord and inner case overlap. However, since the inner case merely serves as a cover body and the power cord can not provide strong bonding force to the inner case, the conventional power connectors may not pass the tensile force test for power cord.

SUMMARY OF THE INVENTION

The present invention is directed to provide a power connector structure utilizing an out-extending protrusion to enhance the bonding force between the inner case and the strain relief structure to improve the product reliability.

According to an embodiment, a power connector structure includes a cable, an inner ring, an inner case, a strain relief structure and an out-extending protrusion. The cable has a plurality of cores, wherein each of the cores extends from a tail of the cable and is electrically connected to a terminal. The inner ring structure collars the tail and is configured for immobilizing the cores and electrically isolating the terminal. The inner case shields the cores and the terminals of the tail and includes a main body and an out-extending protrusion. The main body comprises an accommodating space penetrating therethrough, wherein the inner ring structure and the terminals are respectively configured at a first opening and a second opening of the accommodating space and a portion of the terminals are exposed from the main body. The out-extending protrusion is configured over the first opening proximate to the inner ring structure and extends from the edge of the opening, wherein the out-extending protrusion includes a plurality of protruding ribs and an annular portion connected with at least a portion of the protruding ribs. The strain relief structure is formed on the first opening proximate to the inner ring structure and substantially fills the gap within the opening, wherein the strain relief structure covers the out-extending protrusion and a portion of the cable. The external cover is adapted to the second opening proximate to the terminals and covers the inner case.

Another embodiment of a power connector structure includes a cable, an inner ring, an inner case, a strain relief structure and an external cover and a buckle ring. The cable comprises a plurality of cores, wherein each of the cores extends from a tail of the cable and is electrically connected to an inner contact of a terminal. The inner ring structure collars the tail and is configured for immobilizing the cores and electrically isolating the terminals. The inner case shields the cores and the terminals of the tail and includes a main body and an out-extending protrusion. The main body comprises an accommodating space penetrating therethrough, wherein the inner ring structure and the inner contact of the terminals are respectively configured at a first opening and a second opening of the accommodating space. The out-extending protrusion is configured over the first opening proximate to the inner ring structure and extends from the edge of the opening, wherein the out-extending protrusion includes a plurality of protruding ribs. The strain relief structure is formed on the first opening proximate to the inner ring structure and substantially fills the gap within the opening, wherein the strain relief structure covers the out-extending protrusion and a portion of the cable. The external cover and buckle ring are arranged in pair at both sides of the inner case for covering the inner case.

Other advantages of the present invention will become apparent from the following description taken in conjunction with the accompanying drawings wherein are set forth, by way of illustration and example, certain embodiments of the present invention.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
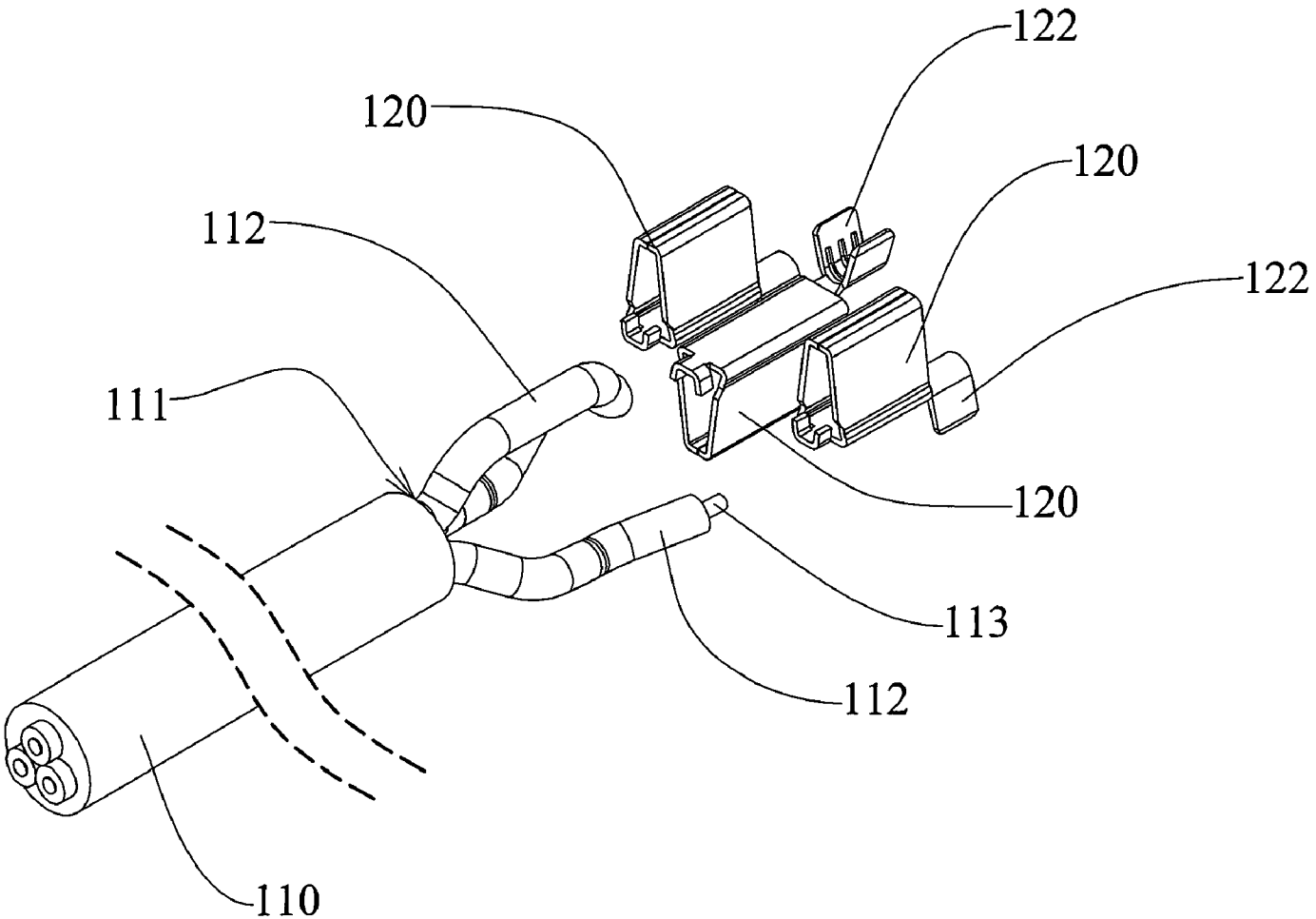
FIGS. 1-6 are assembly diagrams of a power connector structure according to an embodiment of the present invention.
Figure 2:
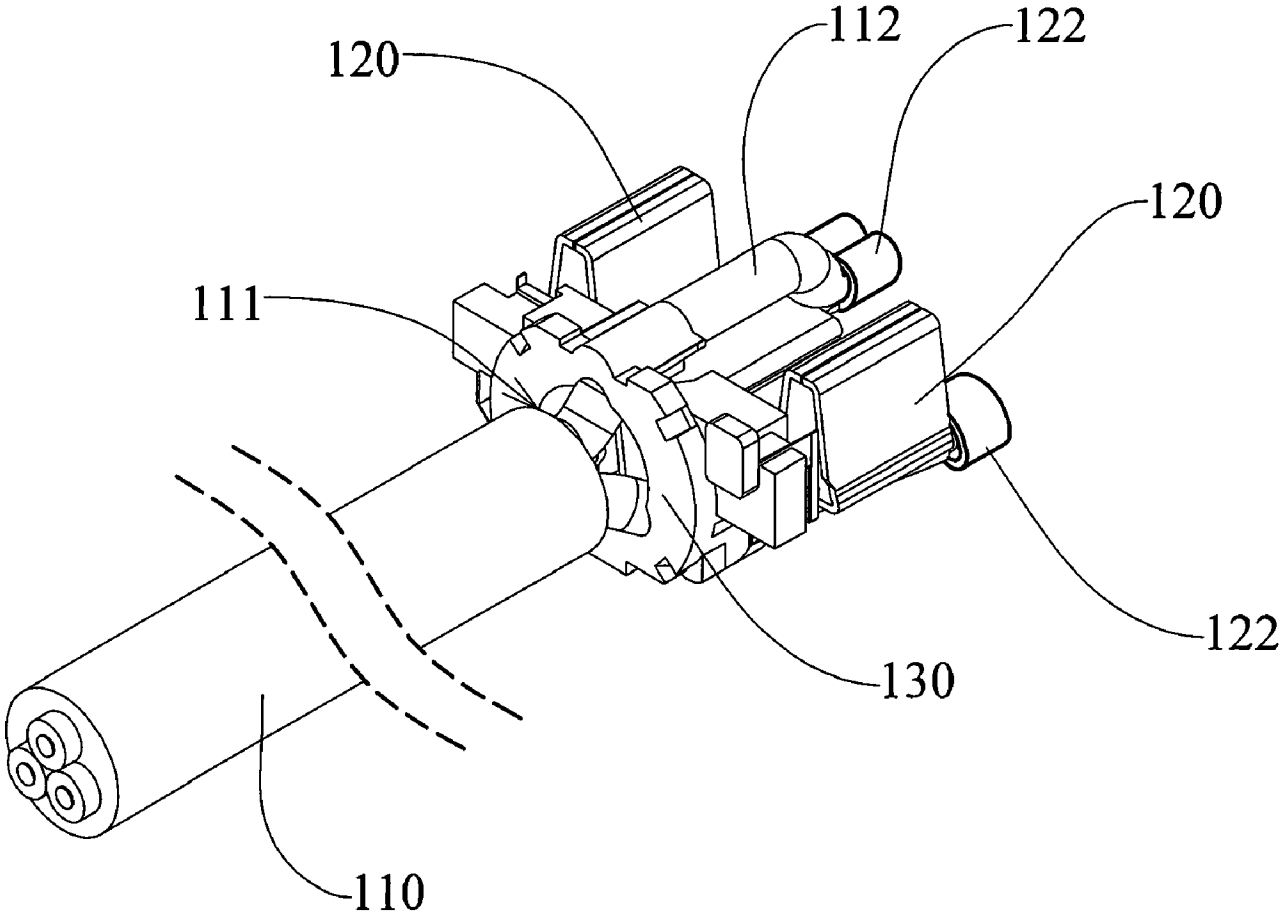

The present invention is described in detail as following, wherein the preferred embodiments provided are for the purpose of illustration and explanation and are not intended to limit the scope of the present invention.

FIGS. 1-5 respectively illustrate assembly diagrams of a power connector structure according to an embodiment of the present invention. First, referring to FIG. 1, a cable 110 comprises a plurality of cores 112, wherein each of the cores 112 extends from a tail 111 of the cable 110 and is electrically connected to a terminal 120. Each of the cores 112 is encapsulated with an insulating film and merely exposes portion for electrical connection, e.g. wire 113, and the wire 113 of the cores 112 are electrically connected to the inner contacts 122 of the terminal 120, respectively. Next, referring to FIG. 2, an inner ring structure 130 collars the tail 111 of the cable 110 and electrically isolates the terminals 120.

Figure 3:
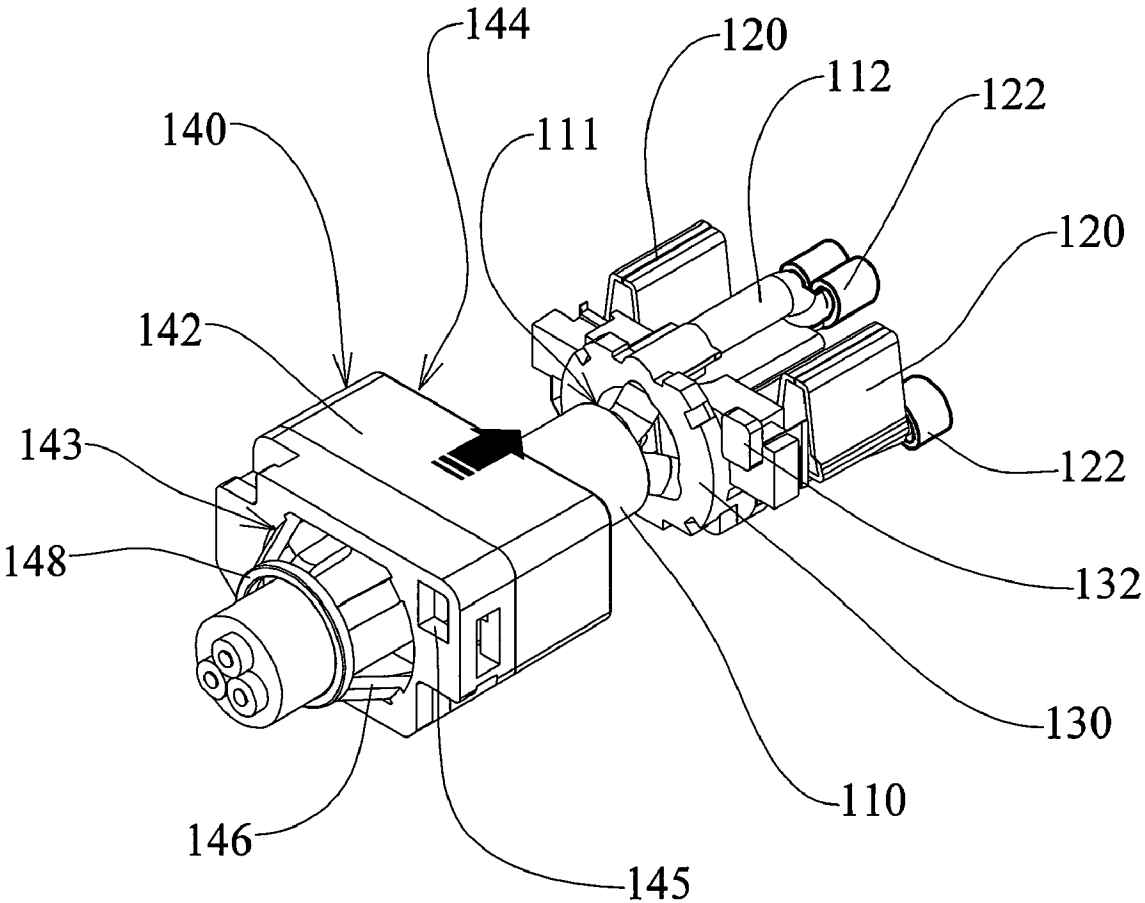

Still referring to FIG. 3, an inner case 140 shields the tail 111 of the cable 110 in arrow direction as illustrated and partially covers the cores 112 and the terminals 120. The inner case 140 includes a main body 142 having an accommodating space penetrating therethrough. The inner ring structure 130 and the terminals 120 are respectively configured at each opening 143, 144 of the accommodating space after being assembled. Particularly, the inner contacts 122 of the 120 terminals are exposed from the main body 142. An out-extending protrusion is configured over the opening 143 proximate to the inner ring structure 130 and extending from the edge of the opening 143, wherein the out-extending protrusion includes a plurality of protruding ribs 146. In an embodiment, the out-extending protrusion further includes an annular portion 148 connected with at least a portion of the protruding ribs 146. Even though in the present embodiment, the annular portion 148 is connected to all of the protruding ribs 146: however, it is not limited thereto. As illustrated in FIG. 3, in another embodiment, the inner ring structure 130 comprises a positioning bump 132 formed on the side of the inner ring structure 130 toward the inner case 140, and the inner case 140 comprises a positioning notch 145 configured for being jointed with the positioning bump 132 on the inner ring structure 130. As illustrated in the present embodiment, the inner contacts 122 of the terminals 120 are exposed from the inner case 140.

Figure 4:
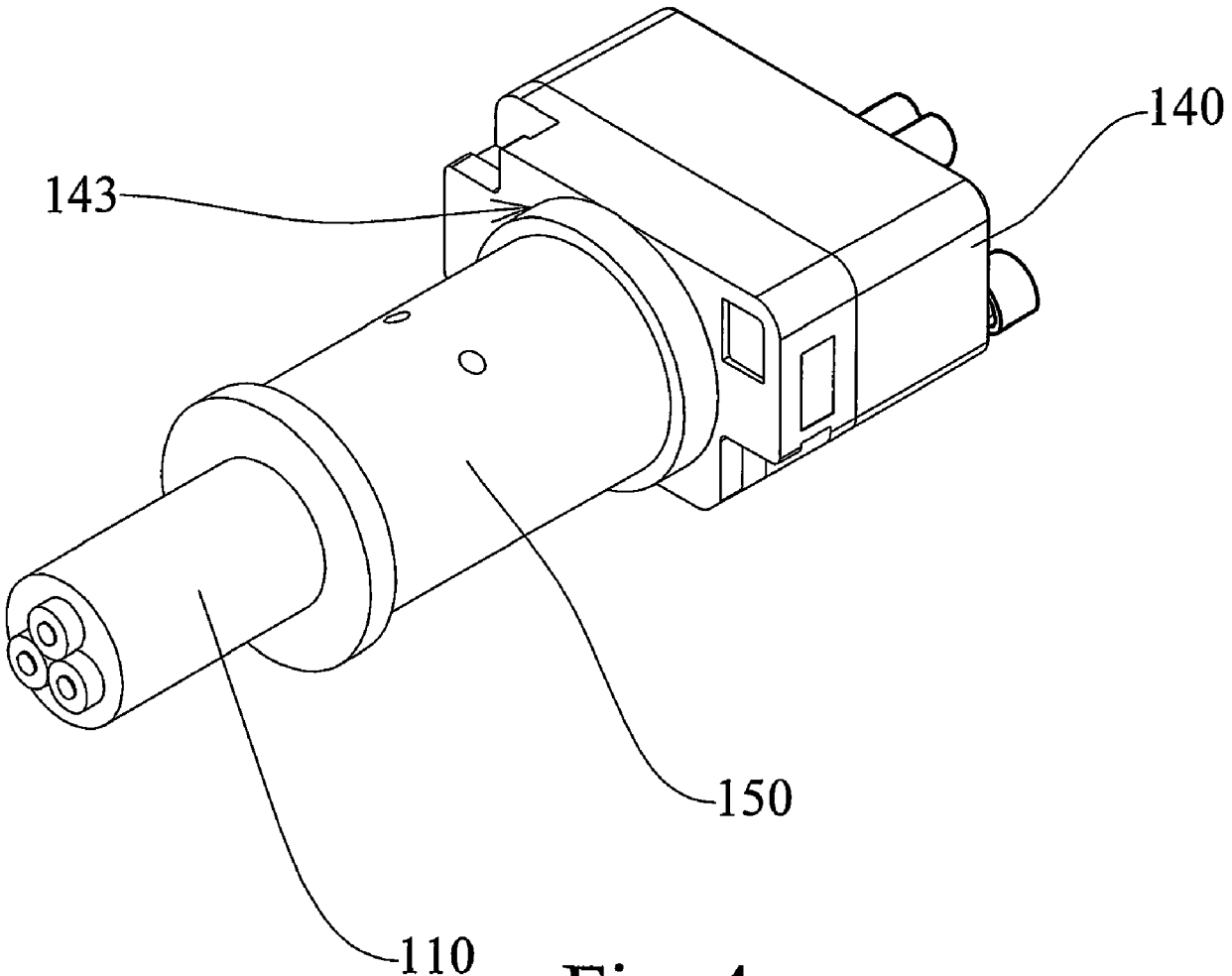
Figure 5:
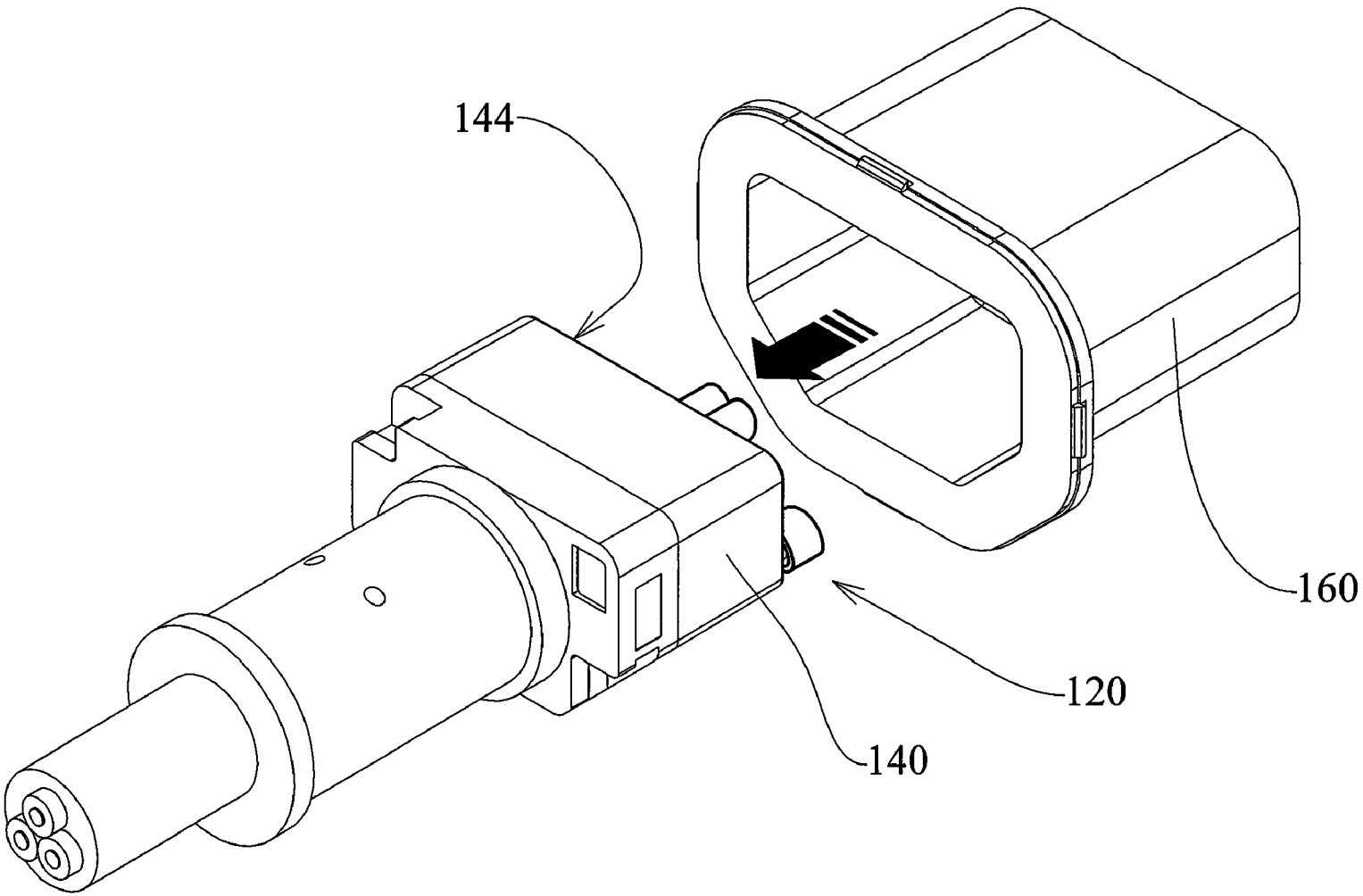
Figure 6:
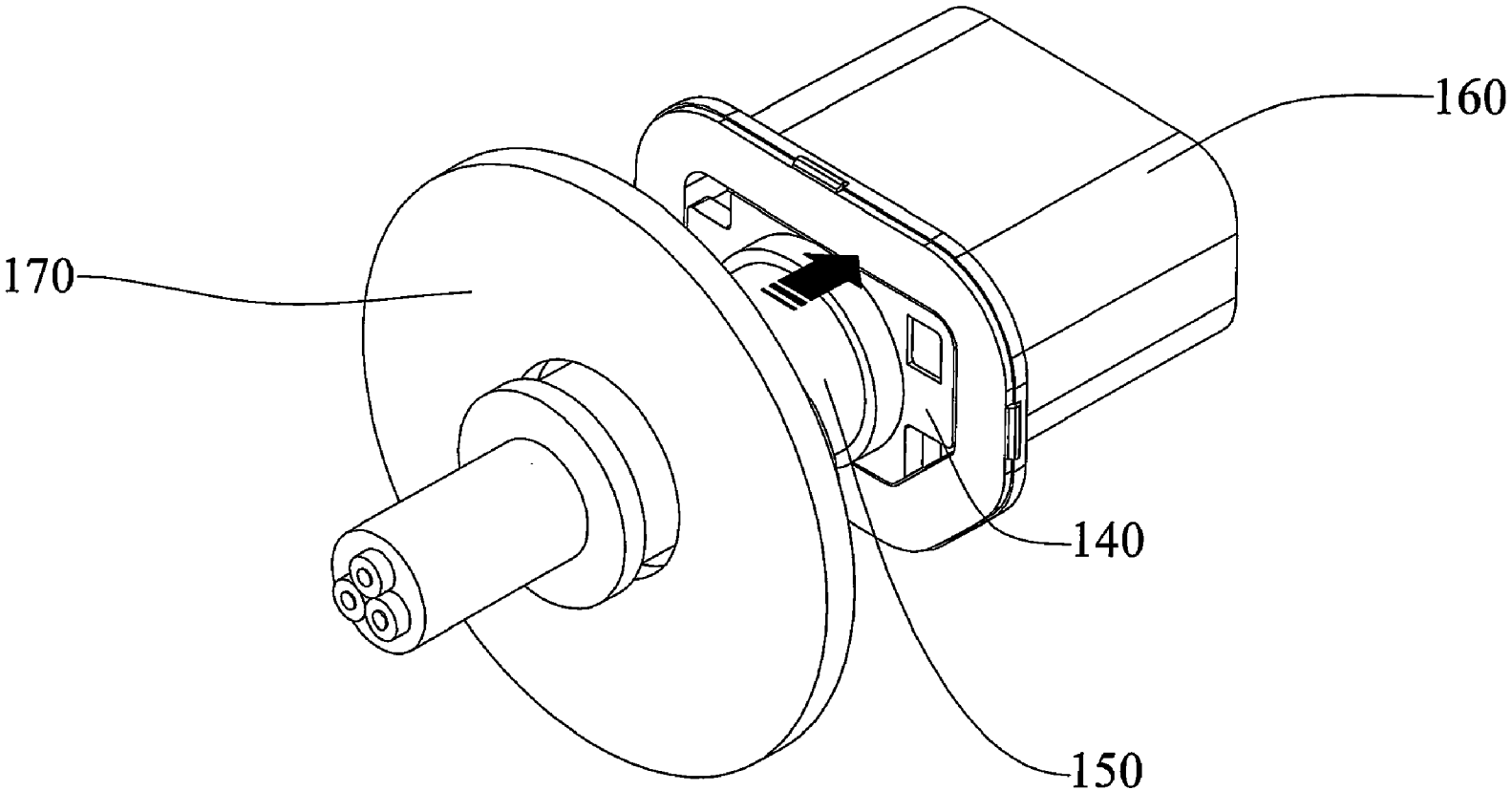

Next referring to FIG. 4, a strain relief structure 150 is formed on the opening 143 proximate to the inner ring structure 130 in a suitable manner, e.g. an insert-molding method and substantially fills the gap within the opening 143 and covers the out-extending protrusion and a portion of the cable 110. In one embodiment, the strain relief structure 150 may be made of an insulating material. An external cover 160 is adapted to the opening 144 proximate to the terminals 120 along arrow direction illustrated in FIG. 5 and covers the inner case 140. As illustrated in FIG. 6, in another embodiment, the power connector structure further includes a buckle ring 170 arranged with the external cover 160 in pair in direction defined from the strain relief structure 150 toward the inner case 140 for covering the inner case 140.

Figure 7B:
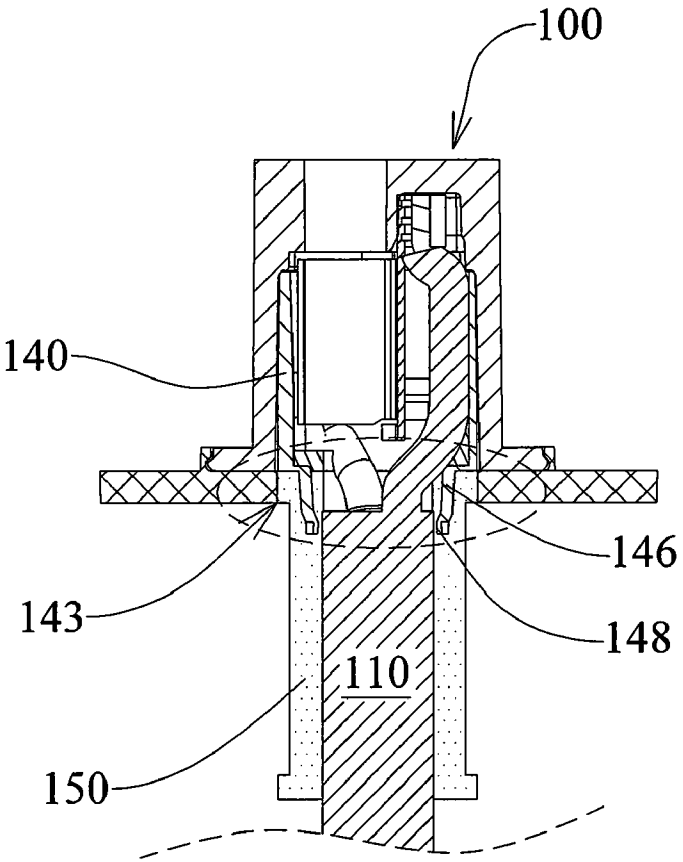
FIG. 7B is a cross-sectional view taken along line A-A of FIG. 7A.
Figure 7A:
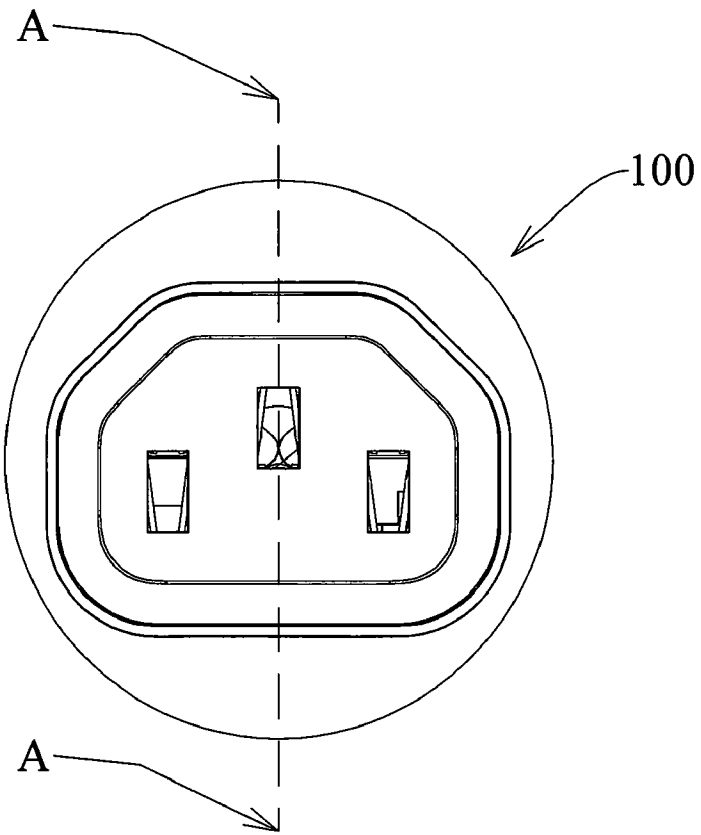
FIG. 7A is a top view diagram illustrating the power connector structure.

FIGS. 7A-B illustrate the assembled power connector structure 100, in which FIG. 7A is a top view diagram illustrating the power connector structure 100, and FIG. 7B is a cross-sectional view of FIG. 7A taken along line A-A. In this embodiment, the protruding ribs 146 of the out-extending protrusion on the inner case 140 extend outwardly from the opening 143 proximate to the inner ring structure 130 and has a shape of a bell, having for example a narrower top, a wider base, and an annular portion 148 surrounds an outer rim of the cable 110. During the forming process of strain relief structure 150, the material forming strain relief structure 150 may flow into the gap within the opening 143 of the inner case 140 and substantially seal the out-extending protrusion so that the power connector structure 100 may have desired structural characteristic and pass the reliability tests, e.g. load capacity test, twisting capacity test, and the like. In another embodiment, the power connector structure further includes at least one connecting segment (not shown) connecting the protruding ribs 146 and forming a web structure with the protruding ribs 146 for strengthening the bonding force between the inner case 140 and the strain relief structure 150. Alternatively, the inner case 140 further includes a coarse surface or an embossing texture formed on the out-extending protrusion 146 for increasing the friction force to the strain relief structure 150. It is understood that the present invention is not limited thereto. For example, the size and shape of the protruding ribs 146 may be modified to practice the present invention, which shall be construed to be within the scope of the present invention.

As aforementioned, one aspect of the present invention includes the out-extending protrusion formed on the inner case, and the out-extending protrusion comprises a shape of stripe, basket, web, or the like for increasing the bonding force to the strain relief structure. In addition, the structure of the out-extending protrusion described above increases the flexibility in using protruding ribs as size, length and shape of the out-extending protrusion has no limitation.

To sum up, a rear cover structure of an electronic card comprises an out-extending protrusion to enhance the bonding force between the inner case and the strain relief structure to effectively increase the reliability of the product.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A power connector structure, comprising:

a cable having a plurality of cores, each of said cores extending from a tail of said cable and electrically connected to a terminal;

an inner ring structure collaring said tail and configured for immobilizing said cores and electrically isolating said terminals;

an inner case shielding said cores and said terminals and comprising:

a main body having an accommodating space penetrating therethrough, wherein said inner ring structure and said terminals are respectively configured at a first end with a first opening and a second end with a second opening that opposites to said first opening of said accommodating space and a portion of said terminals are exposed from said main body; and an out-extending protrusion configured over said first opening proximate to said inner ring structure and extending outwardly and rearward from an edge of said first opening, wherein said out-extending protrusion includes a plurality of protruding ribs and an annular portion thereof is connected to at least a portion of said protruding ribs;

a strain relief structure formed on said first opening proximate to said inner ring structure and substantially filling a gap within said first opening, wherein said strain relief structure covers said protruding ribs and a portion of said cable; and an external cover attached to said second opening proximate to said terminals and covering said inner case;

wherein said inner ring structure comprises a positioning bump formed on a side thereof and towards an interior of said inner case, and said inner case comprises a positioning notch at a rear end thereof configured for being engaged with said positioning bump on said inner ring structure.

2. The power connector structure as claimed in claim 1, further comprising a buckle ring arranged with said external cover in pair at both sides of said inner case for covering said inner case.

3. The power connector structure as claimed in claim 1, wherein said protruding ribs of said out-extending protrusion extend outward from said first opening proximate to said inner ring structure and has a shape of a bell.

4. The power connector structure as claimed in claim 1, wherein said annular portion surrounds an outer rim of said cable.

5. The power connector structure as claimed in claim 1, further comprising at least one connecting segment connecting said protruding ribs and forming a web structure with said protruding ribs.

6. The power connector structure as claimed in claim 1, further comprising a coarse surface or an embossing texture formed on said out-extending protrusion.

7. The power connector structure as claimed in claim 1, wherein said strain relief structure is made of an insulating material.

8. A power connector structure, comprising:

a cable having a plurality of cores, each of said cores extending from a tail of said cable and electrically connected to an inner contact of a terminal;

an inner ring structure collaring said tail and configured for immobilizing said cores and electrically isolating said terminals;

an inner case shielding said cores and said terminals of said tail, and comprising:

a main body having an accommodating space penetrating therethrough, wherein said inner ring structure and said inner contact of said terminals are respectively configured at a first end with a first opening and a second end with a second opening that opposites to said first opening of said accommodating space; and an out-extending protrusion configured over said first opening proximate to said inner ring structure and extending outwardly and rearward from an edge of said first opening, wherein said out-extending protrusion includes a plurality of protruding ribs;

a strain relief structure formed on said first opening proximate to said inner ring structure and substantially filling a gap within said first opening, wherein said strain relief structure covers said protruding ribs and a portion of said cable; and an external cover and a buckle ring positioned on said strain relief structure in pair at both sides of said inner case for covering said inner case;

wherein said inner ring structure comprises a positioning bump formed on a side thereof and towards an interior of said inner case, and said inner case comprises a positioning notch at a rear end thereof configured for being engaged with said positioning bump on said inner ring structure.

9. The power connector structure as claimed in claim 8, wherein said protruding ribs of said out-extending protrusion extend outward from said first opening proximate to said inner ring structure and have a shape of a bell.

10. The power connector structure as claimed in claim 8, wherein said out-extending protrusion comprises an annular portion connected to at least a portion of said protruding ribs.

11. The power connector structure as claimed in claim 10, wherein said annular portion surrounds an outer rim of said cable.

12. The power connector structure as claimed in claim 8, further comprising at least one connecting segment connected to said protruding ribs and forming a web structure with said protruding ribs.

13. The power connector structure as claimed in claim 8, further comprising a coarse surface or an embossing texture formed on said out-extending protrusion.

* * * * *